US007356277B2

(12) United States Patent
Iijima et al.

(10) Patent No.: US 7,356,277 B2
(45) Date of Patent: Apr. 8, 2008

(54) APPARATUS FOR COOLING AN ELECTROPHOTOGRAPHIC IMAGE FORMING APPARATUS

(75) Inventors: Yasuaki Iijima, Kanagawa (JP); Kenichi Takehara, Tokyo (JP); Junya Takigawa, Tokyo (JP); Katsuya Kondoh, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 92 days.

(21) Appl. No.: 11/267,402

(22) Filed: Nov. 7, 2005

(65) Prior Publication Data

US 2006/0110172 A1 May 25, 2006

(30) Foreign Application Priority Data

Nov. 12, 2004 (JP) ..... 2004-329869
Nov. 15, 2004 (JP) ..... 2004-330166
Nov. 15, 2004 (JP) ..... 2004-330167
Sep. 16, 2005 (JP) ..... 2005-269938

(51) Int. Cl.
*G03G 21/20* (2006.01)

(52) U.S. Cl. ..... 399/97; 399/92; 399/94

(58) Field of Classification Search ..... 399/92, 399/94, 97, 44
See application file for complete search history.

(56) References Cited

U.S. PATENT DOCUMENTS 4,248,520 A * 2/1981 Kurita et al. ..... 399/92
4,645,327 A * 2/1987 Kimura et al. ..... 399/97
5,223,902 A * 6/1993 Chodak et al. ..... 399/97
5,600,427 A * 2/1997 Watanabe et al. ..... 399/97
6,151,466 A * 11/2000 Fujiwara ..... 399/92
6,240,265 B1 * 5/2001 Noh ..... 399/92
6,801,742 B1 * 10/2004 Mochimaru et al. ..... 399/92 X
6,898,386 B2 5/2005 Takigawa
6,931,223 B2 * 8/2005 Yamada ..... 399/97
6,947,693 B2 9/2005 Kamiya et al.
7,013,099 B2 * 3/2006 Shirakata ..... 399/92
2003/0053818 A1 * 3/2003 Kimura ..... 399/94
2004/0160646 A1 8/2004 Kudo et al.
2005/0238380 A1 10/2005 Iijima et al.

FOREIGN PATENT DOCUMENTS

JP 9-325671 12/1997
JP 11-338331 12/1999

(Continued)

*Primary Examiner*—Sandra L. Brase
(74) *Attorney, Agent, or Firm*—Oblon, Spivak, McClelland, Maier & Neustadt, P.C.

(57) ABSTRACT

The present invention provides an image forming apparatus which prevents the rusting of metallic components and paper jams and improves the cooling capability of a heat pipe by ensuring that water droplets do not become adhered to the heat pipe, thereby reducing thermal resistance. A fixing apparatus and a printer engine are shielded from each other by a heat receiving plate, a thermal insulation member, and a heat radiating plate. A heat pipe is provided in the shielding member. One end side of the heat pipe is disposed between the fixing apparatus and printer engine to serve as a heat receiving portion, and the other end side of the heat pipe is disposed in a higher position than the one end side to serve as a heat radiating portion. The thermal insulation member covers the periphery of an intermediate portion of the heat pipe between the two end sides of the heat pipe.

13 Claims, 18 Drawing Sheets

FOREIGN PATENT DOCUMENTS

| | | |
|---|---|---|
| JP | 2000-231293 | 8/2000 |
| JP | 2000-259064 | 9/2000 |
| JP | 2001-13855 | 1/2001 |
| JP | 2002-91105 | 3/2002 |
| JP | 2002-366010 | 12/2002 |
| JP | 2003-91189 | 3/2003 |
| JP | 2003-291189 | 10/2003 |

* cited by examiner

APPARATUS FOR COOLING AN ELECTROPHOTOGRAPHIC IMAGE FORMING APPARATUS

BACKGROUND OF THE INVENTION

1. Field of the Invention

The present invention relates to an electrophotographic image forming apparatus such as a copier, printer, or facsimile apparatus, and more particularly to an image forming apparatus that is provided with a function for preventing the rusting of metallic components, preventing paper jams, and improving the cooling capability of a heat pipe by ensuring that water droplets do not become adhered to the heat pipe, thereby reducing thermal resistance.

2. Description of the Background Art

In recent years, an increase in the number of mechanical constitutional components in an electrophotographic image forming apparatus such as a copier has been caused by increased functionality resulting from increased speed, digitalization, and colorization. This has led to an increase in heat-generating members which generate heat, such as a polygon motor and a hard disk, while the overall size of the apparatus main body shows a decreasing trend. As a result, the amount of space between components must be reduced relatively, causing an increase in heat generation density. It is therefore becoming more and more important to provide measures against the effects of heat inside the apparatus, and to develop cooling techniques that can be applied within a restricted space. Moreover, with this increase in heat density, the moisture contained in paper is evaporated by the fixing apparatus, and water generated within the apparatus may cause rusting of the metallic components and jams when the water falls onto the paper. Therefore, measures against water vapor inside the apparatus must also be taken.

As an example of the prior art relating to these problems, Japanese Unexamined Patent Application Publication 2003-91189 (abbreviated to Prior Art Reference 1 hereafter) discloses an image forming apparatus comprising an imaging apparatus which forms a toner image on a photosensitive body and then transfers the toner image onto a sheet of paper, and a fixing apparatus provided in the vicinity of the imaging apparatus for fixing the toner image transferred onto the paper by means of heat. A heat shielding plate and a heat pipe are disposed between the imaging apparatus and fixing apparatus, a heat radiating fin is disposed at one end of the heat pipe, and a fan is provided for forcibly cooling the heat radiating fin.

Further, Japanese Unexamined Patent Application Publication 2002-091105 (abbreviated to Prior Art Reference 2 hereafter) discloses an image forming apparatus provided with a mechanism for discharging water vapor generated in the apparatus to the outside of the apparatus using the surface of thermal insulation means (a thermal insulation member 5*a*) as an inner wall of a duct (ventilation duct 4*b*) (see FIGS. 5, 6).

Further, Japanese Unexamined Patent Application Publication H9-325671 (abbreviated to Prior Art Reference 3 hereafter) discloses an electrophotographic apparatus in which the operation of an exhaust fan (a fan 42 in the document) is controlled in accordance with a humidity value (when the absolute humidity reaches or exceeds 20 g/m$^3$, the fan 42 is rotated in reverse to discharge air from the apparatus main body).

Further, Japanese Unexamined Patent Application Publication 2000-259064 (abbreviated to Prior Art Reference 4 hereafter) discloses a heat discharge apparatus in which a duct is provided so as to pass between a heat source portion for discharging heat and an affected portion that is affected by the heat, an exhaust port of the duct is opened onto the upper portion of the apparatus, and intake ports are opened on both sides of the heat source portion in lower positions than the exhaust port. Moreover, a thermal insulation member is provided on an outer casing part of the heat source portion on the side facing the affected portion, and a communicative port which connects the interior space of the duct to the space in the vicinity of the heat source portion is provided on the route of the duct on the opposite side of the thermal insulation member.

Further, Japanese Unexamined Patent Application Publication H11-338331 (abbreviated to Prior Art Reference 5 hereafter) discloses a heat shielding apparatus for preventing the transfer of the heat from a heat source portion inside an image forming apparatus to a portion to be protected, in which a ventilating duct having an exhaust port on the upper side of the heat source portion and an intake port on the lower side of the exhaust port is provided between the heat source portion and the portion to be protected, a thermal insulation portion is provided on the side of the heat source portion between the heat source portion and the ventilating duct, and a heat radiating portion is provided on the side of the ventilating duct between the heat source portion and the ventilating duct.

Further, Japanese Unexamined Patent Application Publication 2001-013855 (abbreviated to Prior Art Reference 6 hereafter) discloses an image forming apparatus for recording an image on a sheet of paper using an image recording portion, inserting the recorded paper into a fixing apparatus, and fixing the recorded image. A cooling duct is disposed between the image recording portion and the fixing apparatus so as to shield the image recording portion and fixing apparatus from each other, a temperature sensor is provided inside the cooling duct, and when the temperature sensor detects that the temperature inside the cooling duct has reached a predetermined temperature, an axial fan is operated so that air is introduced into the cooling duct.

Further, Japanese Unexamined Patent Application Publication 2000-231293 (abbreviated to Prior Art Reference 7 hereafter) discloses an image forming apparatus comprising image forming means for forming an image on a sheet of paper, fixing means for heat-fixing the image formed on the paper by the image forming means, a paper conveyance path for conveying the paper subjected to heat-fixing by the fixing means to a paper discharge portion, and a water absorbing member provided in the vicinity of the paper conveyance path for absorbing moisture and drying the paper conveyance path.

Further, Japanese Unexamined Patent Application Publication 2002-366010 (abbreviated to Prior Art Reference 8 hereafter) discloses an image forming apparatus comprising one or a plurality of image carriers, one or a plurality of image forming means for forming a toner image on the image carrier, transfer means for transferring the toner image forming on the image carrier to a recording medium directly or via an intermediate transfer body, fixing means constituted by a fixing roller, heating means for heating the fixing roller, and roller temperature detecting means for detecting the temperature of the fixing roller, the heating means being controlled on the basis of the output of the roller temperature detecting means, exhaust means for discharging air in the apparatus to the outside of the apparatus, means for detecting the temperature and humidity on the outside of the apparatus, and means for detecting the temperature and humidity on the inside of the apparatus. The apparatus has a first standby mode in which the heating means and exhaust means are operated, and a second standby mode in which the heating means are operated but the exhaust means are halted, and switches between the first standby mode and second standby mode in accordance with the difference between the detected humidity and temperature on the inside and outside of the apparatus.

With the technique disclosed in Prior Art Reference 1, thermal insulation is provided by the heat shielding plate, thereby preventing rusting of the metallic components and paper jams caused by water vapor, and the heat shielding plate is cooled by the heat pipe and so on, leading to an improvement in the thermal insulation effect. However, with this technique, rusting of the metallic components may occur when water vapor generated as paper passes through the fixing apparatus adheres to the heat pipe, and paper jams may occur when water falls onto the paper.

The techniques disclosed in Prior Art References 4 to 8 are effective in dealing with heat and water vapor inside the respective apparatuses, but under the current circumstances described above, in which the space between components is small, causing an increase in heat generation density, it is impossible to discharge sufficient water vapor from the apparatus with these techniques when the apparatus is operated continuously for a long time period. Therefore, these techniques are not able to sufficiently solve the problems described above relating to rusting of the metallic components and paper jams caused by moisture.

As well as the aforementioned problems in the prior art, when water vapor that is generated as paper passes through the fixing apparatus adheres to the heat pipe, thermal resistance from the outside is generated in the heat pipe, leading to a reduction in the cooling capability of the heat pipe.

SUMMARY OF THE INVENTION

A first object of the present invention is to prevent the rusting of metallic components and paper jams and to improve the cooling capability of a heat pipe by ensuring that water droplets do not become adhered to the heat pipe, thereby reducing thermal resistance.

A second object of the present invention is to discharge sufficient heat and water vapor from the inside of an image forming apparatus to the outside of the apparatus so that rusting of the metallic components, paper jams, and so on caused by moisture can be prevented.

A third object of the present invention is to provide an electrophotographic image forming apparatus for achieving the first object described above.

A fourth object of the present invention is to provide an electrophotographic image forming apparatus for achieving the second object described above.

In accordance with the present invention, an electrophotographic image forming apparatus for forming an image on a sheet of paper comprises: a shielding member for shielding a fixing apparatus for fixing an image on the sheet of paper and a cooling subject portion in the interior of the image forming apparatus from each other; a heat pipe provided on the shielding member, one end side of which is disposed between the fixing apparatus and the cooling subject portion to serve as a heat receiving portion, and another end side of which is disposed in a higher position than the one end side to serve as a heat radiating portion; and a thermal insulation member which covers the entire circumference of an intermediate portion of the heat pipe between the two end sides of the heat pipe.

Further, in accordance with the present invention, an electrophotographic image forming apparatus for forming an image on a sheet of paper comprises: a thermal insulation apparatus provided between a fixing apparatus for fixing an image on the sheet of paper and a cooling subject portion in the interior of the image forming apparatus; a duct for connecting an upper side of the fixing apparatus to the exterior of the image forming apparatus; a fan for forcibly discharging air inside the duct to the outside of the image forming apparatus; a humidity sensor provided in the image forming apparatus; and a device for driving the fan when a humidity value detected by the humidity sensor is greater than a preset reference value, and stopping the fan when the humidity value is smaller than the reference value.

BRIEF DESCRIPTION OF THE DRAWINGS

The above and other objects, features, and advantages of the present invention will become more apparatus from the following detailed description taken with the accompanying drawings, in which.

DESCRIPTION OF THE PREFERRED EMBODIMENTS

Embodiments of the present invention will now be described in detail with reference to the drawings.

Figure 1:
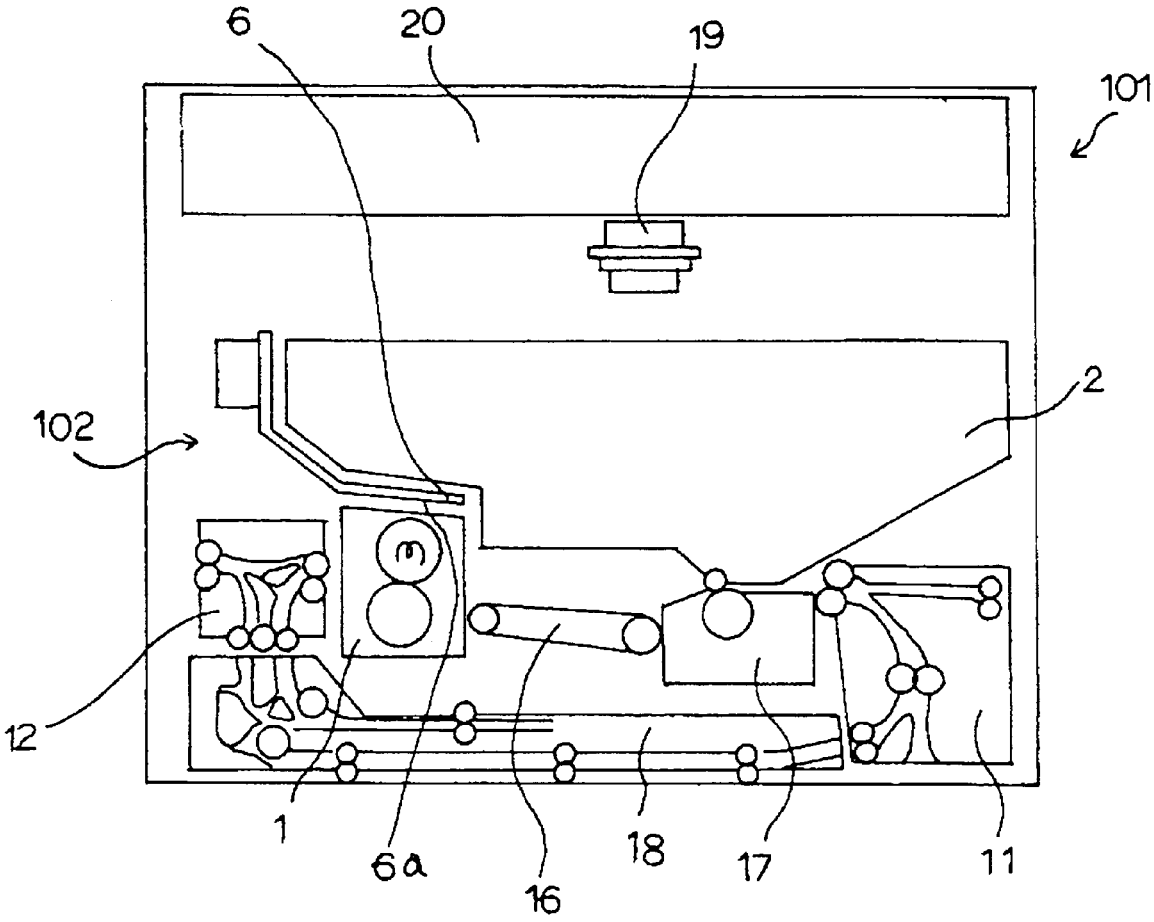
FIG. 1 is a schematic diagram showing the constitution of an image forming apparatus according to an embodiment 1 of the present invention.

FIG. 1 shows the schematic constitution of an image forming apparatus 101 according to an embodiment 1 of the present invention. The image forming apparatus 101 is an electrophotographic image forming apparatus, and in this example is constituted by a digital copier. The image forming apparatus 10 comprises a fixing apparatus 1 and a printer engine 2 having well-known constitutions. The fixing apparatus 1 fixes toner onto a sheet of paper using heat and pressure, and therefore constitutes a heat generating member which generates a large amount of heat. The printer engine 2 is installed with photosensitive drums, a developing apparatus, and other various well-known apparatuses for realizing an electrophotographic process, and serves to form a toner image on the photosensitive drums. For example, the printer engine 2 comprises four photosensitive drums corresponding to four toner colors Y, M, C, K, and a transfer belt onto which the toner images of each color, formed respectively on the photosensitive drums, are transferred and superposed in sequence. The printer engine 2 must avoid heating and be cooled to prevent excessive heating, and therefore constitutes a cooling subject portion.

A scanner 20 reads an original document to be subjected to image formation by the printer engine 2. A transfer apparatus 17 transfers the toner image formed by the printer engine 2 (a color image formed by superposing the toner images of each color onto the transfer belt) onto a sheet of paper. A paper supply apparatus 11 supplies the transfer apparatus 17 with paper, and a conveyor belt 16 conveys the paper to the fixing apparatus 1 following transfer. A paper discharge apparatus 12 discharges the paper, onto which the toner image has been transferred and then fixed by the fixing apparatus 1, to the outside of the apparatus. A duplex apparatus 18 reverses the surface of the paper on which the toner image is formed and supplies the transfer apparatus 17 with the paper again, thereby enabling duplex printing. Note that the reference numeral 19 denotes a polygon motor for driving a polygon mirror (not shown) to rotate, and the reference numeral 102 denotes a thermal insulation apparatus.

Figure 2:
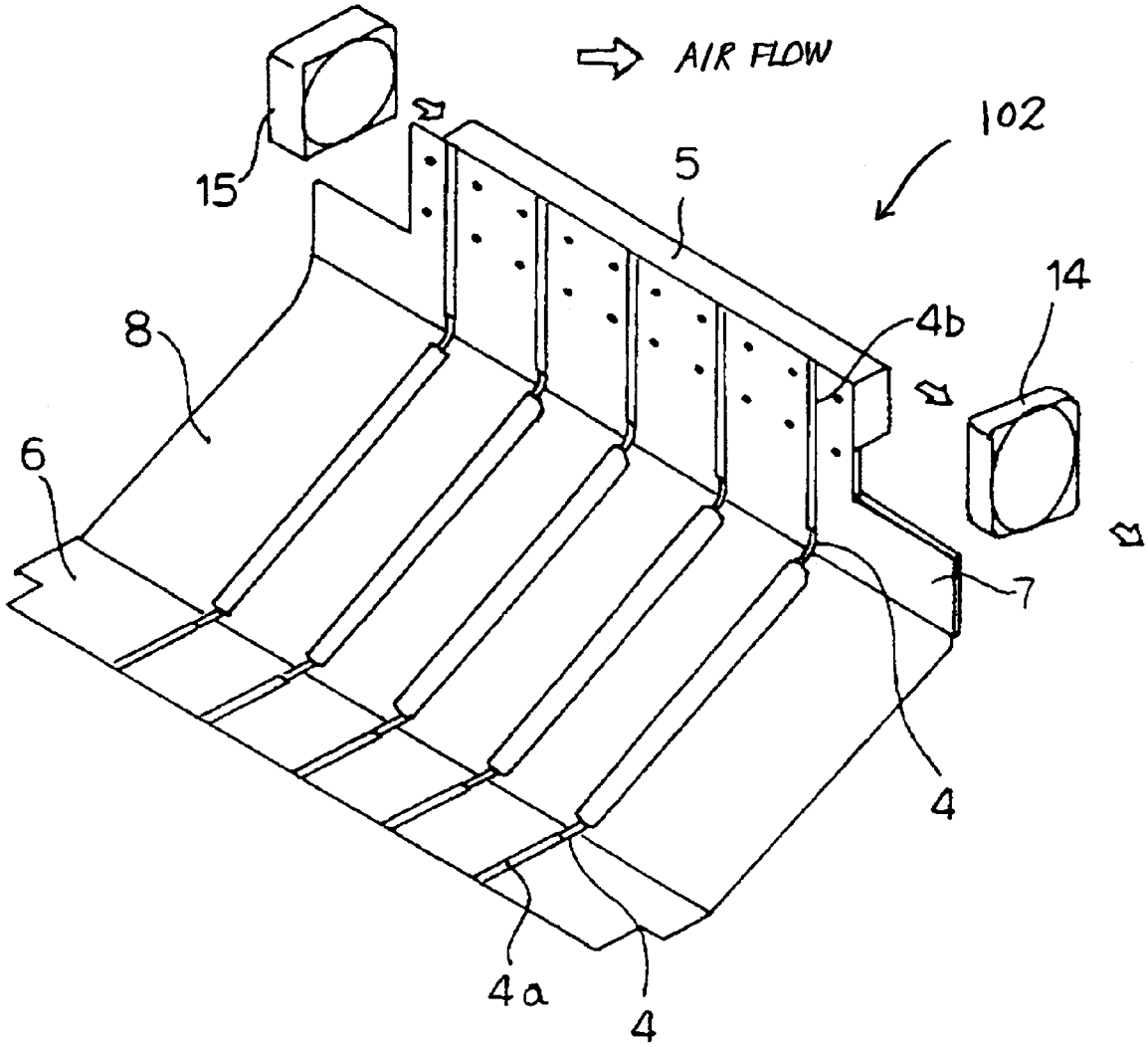
FIG. 2 is a perspective view showing the constitution of a thermal insulation apparatus provided in the image forming apparatus.
Figure 3:
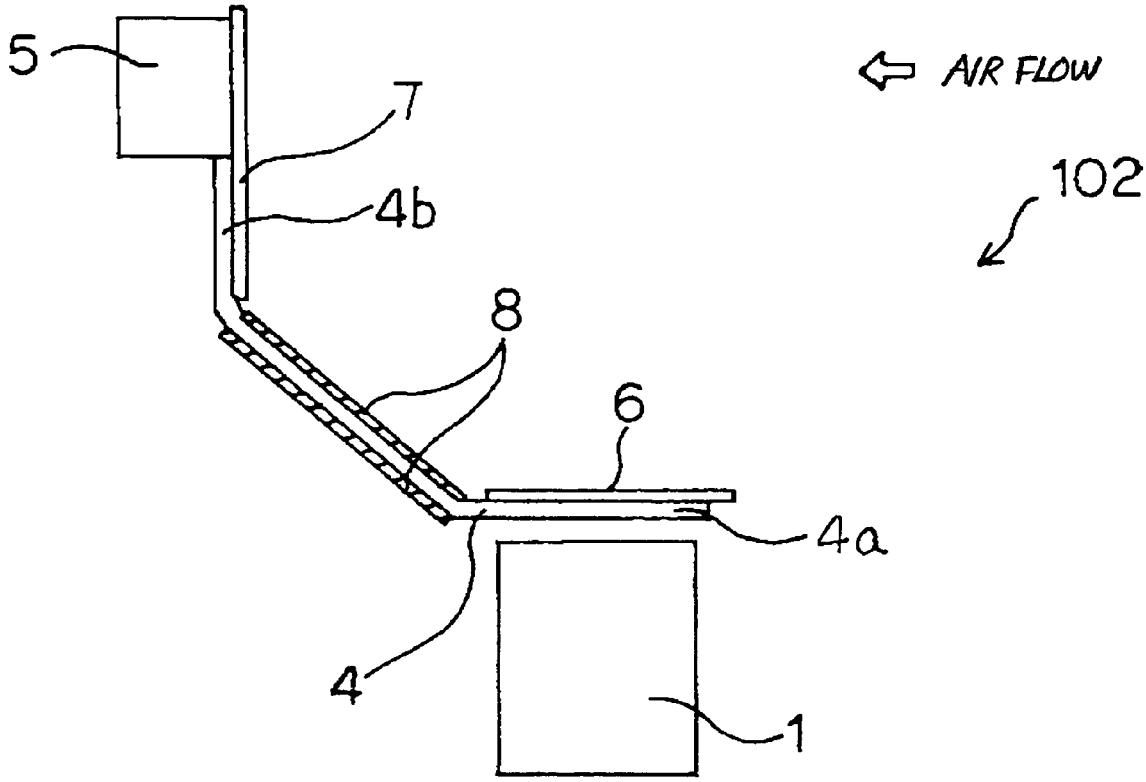
FIG. 3 is a longitudinal sectional view showing the constitution of the thermal insulation apparatus.

FIG. 2 shows the outer form of the thermal insulation apparatus 102, and FIG. 3 shows a cross-section of the thermal insulation apparatus 102 severed along a heat pipe 4 part to be described below. Note that both drawings illustrate air flow using black-outlined arrows.

The thermal insulation apparatus 102 shields and insulates the fixing apparatus 1 and printer engine 2 from each other. The thermal insulation apparatus 102 comprises a plurality of heat pipes 4. As shown in FIG. 1, one end portion side 4*a* serving as a heat receiving portion of each heat pipe 4 is disposed between the fixing apparatus 1 and printer engine 2. A heat receiving plate 6 serving as a heat receiving member which is formed from a material with a favorable heat absorption property is mounted on the one end portion side 4*a*.

Another end portion side 4*b* serving as a heat radiating portion of each heat pipe 4 is disposed in a higher position than the end portion side 4*a* serving as the heat receiving portion. In this example, the other end portion side 4*b* is disposed on the side portion of the printer engine 2, as shown in FIG. 1. A heat radiating plate 7 serving as a heat radiating member formed from a material with a favorable heat radiating property is mounted on the other end portion side 4*b*. A heat sink 5 is formed on the heat radiating plate 7, and the heat sink 5 is cooled by a blast from a fan 15 (see FIG. 2).

A plate-form thermal insulation member 8 formed using a mold is provided in an intermediate portion between the heat radiating portion side and heat receiving portion side of each heat pipe 4 so that the entire circumference of the intermediate portion is covered by the thermal insulation member 8 and thereby thermally insulated from its surroundings. Note that the thermal insulation member 8, heat receiving plate 6, and heat radiating plate 7 constitute a shielding member.

Thus the entire circumference of the intermediate portion of the heat pipe 4 is covered by the thermal insulation member 8 and thermally insulated from its surroundings. Therefore, water vapor generated when paper passes through the fixing apparatus 1 and paper discharge apparatus 12 does not adhere to the heat pipe 4. As a result, the rusting of metallic components caused by water droplets and paper jams caused by falling water droplets can be prevented. Note that paper jams caused by falling water droplets occur when water droplets adhered to the heat pipe 4 fall onto the paper discharge apparatus 12 or duplex apparatus 18 and become adhered to paper passing through these apparatuses, causing friction to increase between the parts to which the water droplets are adhered and members on the paper conveyance path, such as a guide plate, so that the paper catches on these members.

Furthermore, the heat pipe 4 only receives heat on the heat receiving side, and hence no external heat resistance is applied to the heat pipe 4. As a result, the cooling capability of the heat pipe 4 can be improved. Hence, heat from the fixing apparatus 1 is transferred by the heat pipe 4 from a heat receiving surface 6*a* (on the fixing apparatus 1 side) of the heat receiving plate 6 to the heat sink 5 via the heat radiating plate 7, cooled by the blast from the heat sink fan 15, and discharged from the apparatus by a discharge fan 14.

Figure 4:
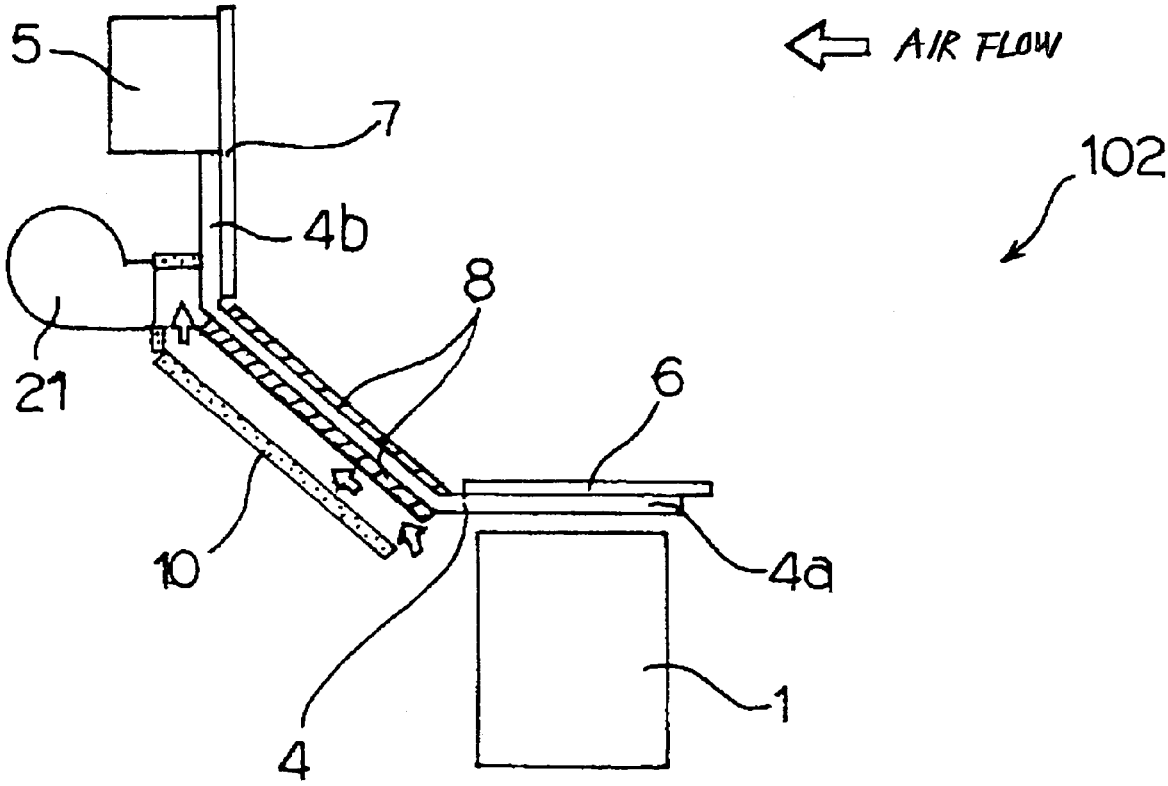
FIGS. 4 and 5 are sectional views showing the constitution of a thermal insulation apparatus according to a modification of embodiment 1.

FIG. 4 shows the constitution of a modification of the thermal insulation apparatus 102 described above.

As shown in FIG. 4, this modification differs from the thermal insulation apparatus 102 described above in that a duct 10 having the thermal insulation member 8 as at least a part of the inner wall thereof is provided, an inlet of the duct 10 is formed near the upper portion of the fixing apparatus 1, or more specifically near an upper portion of a paper outlet of the fixing apparatus 1, the inlet communicates with the exterior of the apparatus, and an exhaust fan 21 forcibly discharges the air inside the duct 10. As a result, the water vapor that is generated when paper passes through the fixing apparatus 1 and paper discharge apparatus 12 can be discharged to the outside of the apparatus effectively.

Water vapor is generated particularly at a fixing nip in the interior of the fixing apparatus 1, and almost all of the generated water vapor flows out of the fixing apparatus 1 from the paper outlet of the fixing apparatus 1. Therefore, by disposing the inlet of the duct 10 near the upper portion of the paper outlet of the fixing apparatus 1, as in this modification, the water vapor that is generated in the image forming apparatus can be discharged to the outside of the apparatus effectively.

Further, in the image forming apparatus 101 comprising the duct 10, control such as that described below may be performed.

Figure 5:
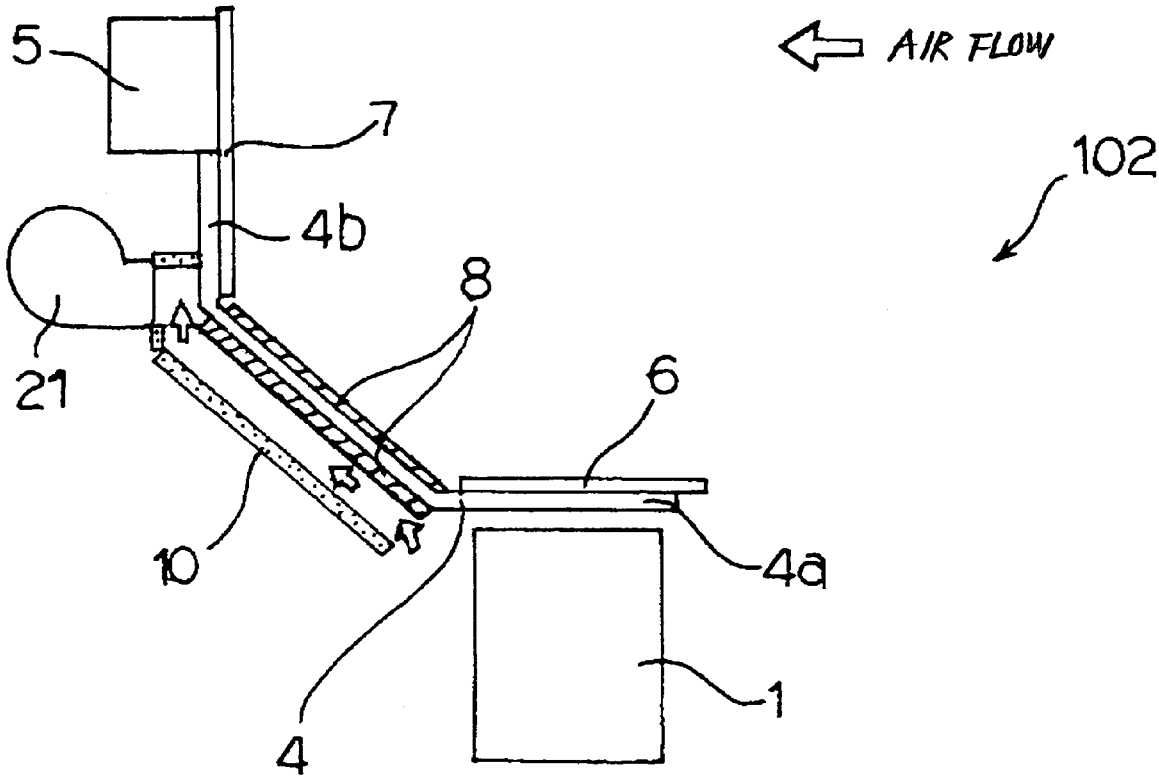

First, as shown in FIG. 5, a humidity sensor 22 is provided inside the duct 10. Note that the position of the humidity sensor 22 is not limited to the interior of the duct 10, and various positions in the interior of the image forming apparatus 101, such as the vicinity of the fixing apparatus 1, may be selected.

Figure 6:
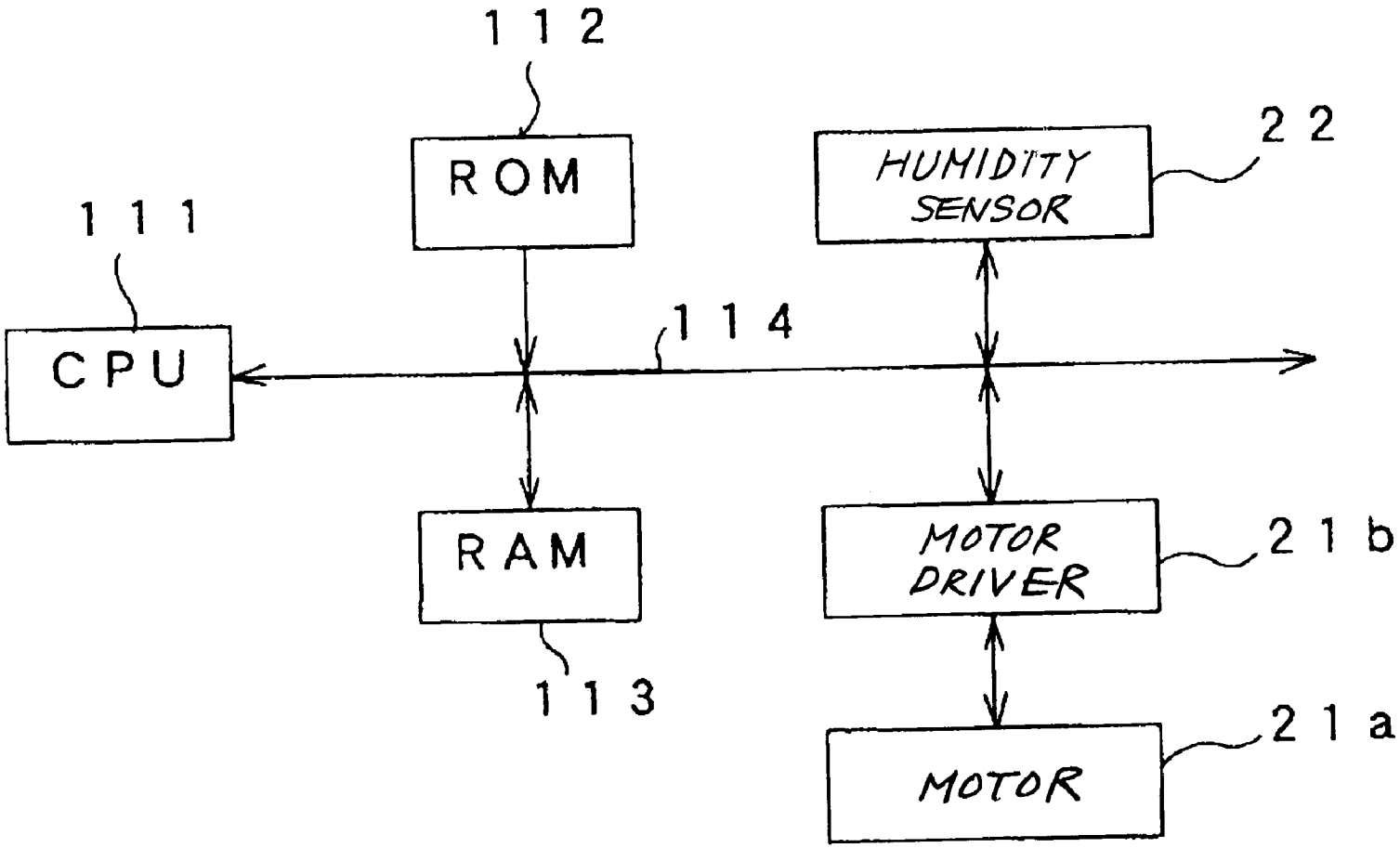
FIG. 6 is a block diagram showing the electric constitution of a control system in the image forming apparatus.

FIG. 6 shows the constitution of a control system for the image forming apparatus 101, including the humidity sensor 22. A CPU 111 performs comprehensive control of each portion of the image forming apparatus 101. A ROM 112 stores various control programs and fixed data used by the CPU 111, and a RAM 113 serves as a working area of the CPU 111. The ROM 112 and RAM 113 are connected to the CPU 111 by a bus 114.

The humidity sensor 22 is also connected to the bus 114, and a motor 21*a* for driving the exhaust fan 21 is connected to the bus 114 via a motor driver circuit 21*b*. Various other sensors and actuators used in the image forming apparatus 101 are also connected to the bus 114, but these have well-known constitutions, and hence detailed illustration and description thereof have been omitted.

Figure 7:
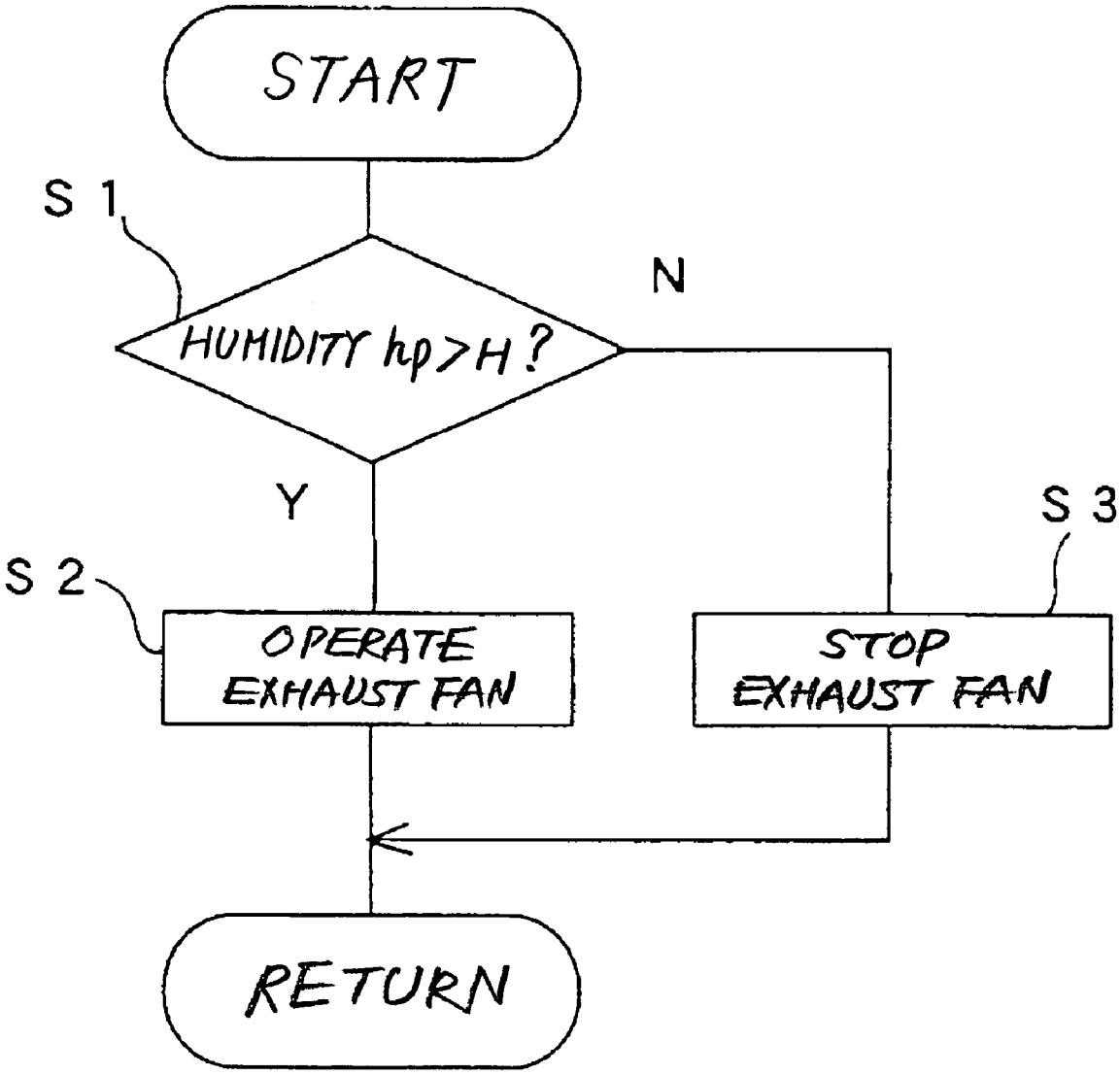
FIG. 7 is a flowchart illustrating control that is executed by the image forming apparatus.

FIG. 7 is a flowchart illustrating the content of the unique control that is executed in this type of control system by the CPU 111 on the basis of a control program stored in the ROM 112. As shown in FIG. 7, the CPU 111 operates the exhaust fan 21 in accordance with a humidity hp detected by the humidity sensor 22. More specifically, the humidity hp is compared to a preset reference value H (step S1). When the humidity hp exceeds the reference value H (Y in step S1), the motor 21*a* is driven to operate the exhaust fan 21 (step S2), and when the humidity hp is equal to or lower than the reference value H, the exhaust fan 21 is stopped (step S3).

Hence, when it is determined that the humidity in the interior of the image forming apparatus 101 is excessively high due to continuous operation of the apparatus or the like, water vapor is forcibly discharged from the interior of the apparatus by the exhaust fan 21, thereby promoting the discharge of water vapor out of the apparatus so that rusting of the metallic components and paper jams caused by moisture can be prevented. Furthermore, the exhaust fan 21 is only operated when the humidity in the interior of the apparatus is excessively high, and therefore noise generated by an operation of the exhaust fan 21 can be suppressed to a minimum.

Next, an embodiment 2 of the present invention will be described.

Figure 8:
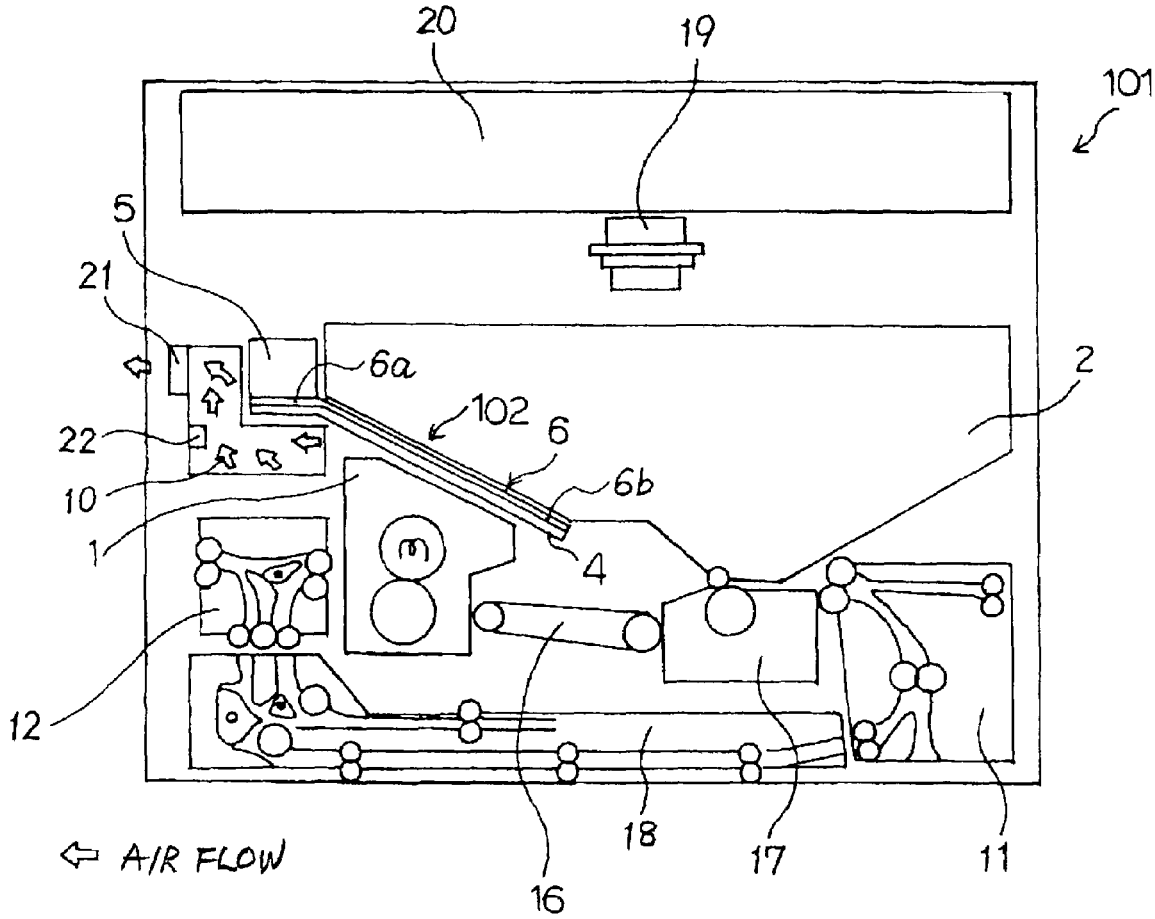
FIG. 8 is a schematic diagram showing the constitution of an image forming apparatus according to an embodiment 2 of the present invention.
Figure 9:
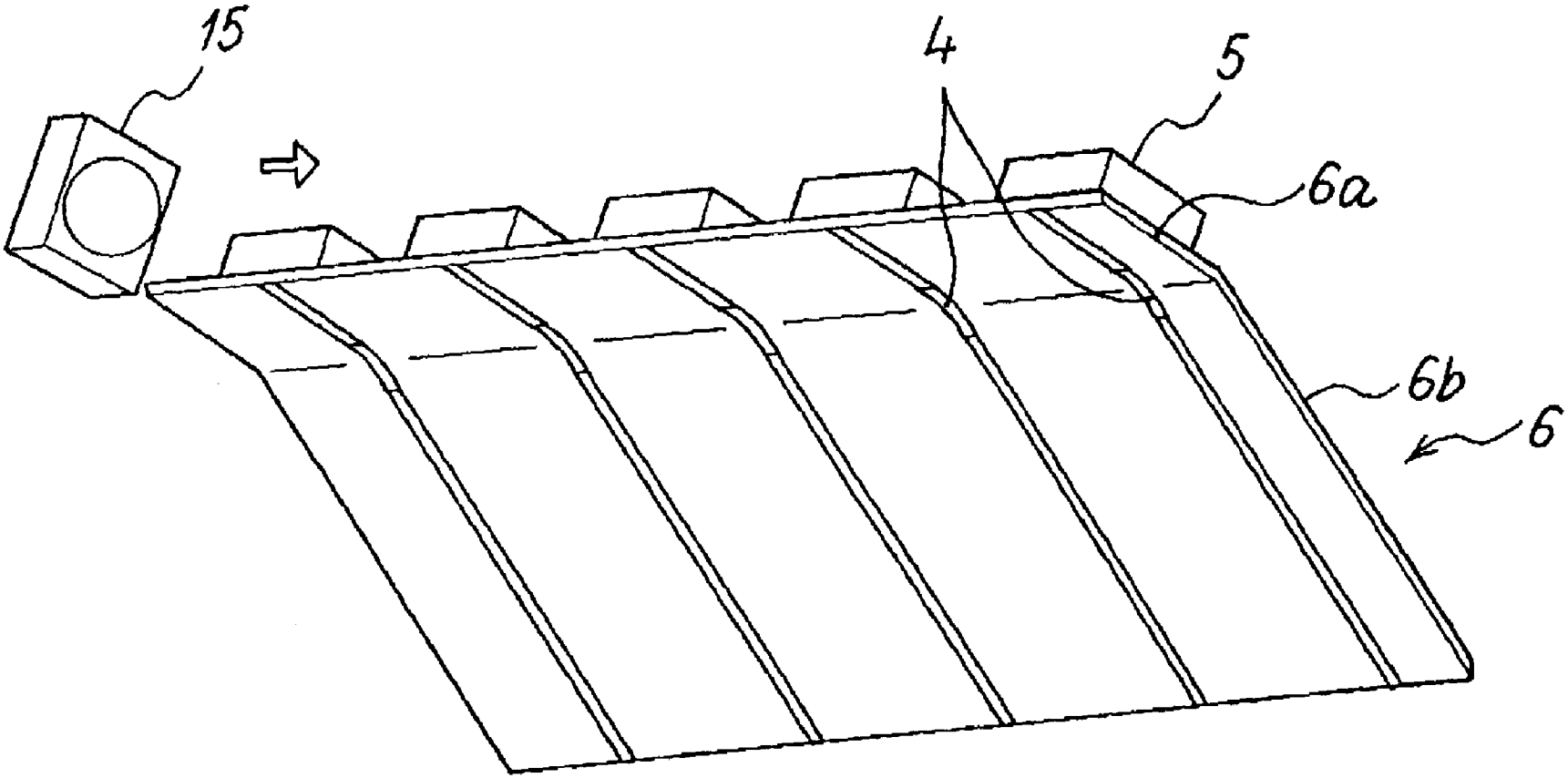
FIG. 9 is a perspective view showing the constitution of a thermal insulation apparatus provided in the image forming apparatus.

FIG. 8 shows the schematic constitution of the image forming apparatus 101 of embodiment 2, and FIG. 9 shows the constitution of the thermal insulation apparatus 102 used in this image forming apparatus 101. The constitution of embodiment 2 is substantially identical to the constitution of embodiment 1 described above. Therefore, identical reference numerals have been used, and detailed description has been omitted.

In embodiment 2, the thermal insulation apparatus 102 is constituted by the heat pipe 4, the heat sink 5, the shielding plate 6, and so on. The shielding plate 6 is disposed to shield the fixing apparatus 1 serving as a heat generating member and the printer engine 2 serving as a cooling subject portion from each other. As is shown clearly in the drawing, the shielding plate 6 is constituted by a horizontal plate portion 6*a* disposed on the side portion of the printer engine 2 horizontally in the plate width direction, and an inclined plate portion 6*b* connected to the horizontal plate portion 6*a*, which is disposed in a lower position than the horizontal plate portion 6*a* and inclined in the plate width direction so as to shield the fixing apparatus 1 and printer engine 2 from each other. A plurality of the heat sinks 5 is provided on the horizontal plate portion 6*a*, and a plurality of the heat pipes 4 is provided from the horizontal plate portion 6*a* along the inclined plate portion 6*b*. The fan 15 is provided in the vicinity of the heat sinks 5 (see FIG. 9).

The heat generated by the fixing apparatus 1 is transferred to the heat sinks 5 by the heat pipes 4, and the heat sinks 5 are cooled by a blast from the heat fan 15. Thus the thermal insulation apparatus 102 shields the fixing apparatus 1 and printer engine 2 from each other using the shielding plate 6, and cools the shielding plate 6 using the heat pipes 4, heat sinks 5, and fan 15. As a result, the fixing apparatus 1 and printer engine 2 are thermally insulated from each other.

Further, the duct 10 is provided on the upper portion of the paper discharge apparatus 12 in the vicinity of, and diagonally above, the fixing apparatus 1. The inlet of the duct 10 is formed on the fixing apparatus 1 and paper discharge apparatus 12 side, and the duct 10 communicates with the exterior of the image forming apparatus 101. The exhaust fan 21 is provided in the duct 10 for forcibly discharging air and water vapor from the inside of the duct 10 to the outside of the apparatus (the air flow through the interior of the duct 10 is illustrated in the drawing by black-outlined arrows).

In embodiment 2, as shown in FIG. 8, the humidity sensor 22 is provided inside the duct 10. Note that the position of the humidity sensor 22 is not limited to the interior of the duct 10, and various positions in the interior of the image forming apparatus 101, such as the vicinity of the fixing apparatus 1, may be selected. Similarly to the modification described above, the CPU 111 operates the exhaust fan 21 in accordance with the humidity hp detected by the humidity sensor 22. More specifically, the humidity hp is compared to the preset reference value H (step S1). When the humidity hp exceeds the reference value H (Y in step S1), the motor 21*a* is driven to operate the exhaust fan 21 (step S2), and when the humidity hp is equal to or lower than the reference value H, the exhaust fan 21 is stopped (step S3). Hence, when it is determined that the humidity in the interior of the image forming apparatus 101 is excessively high due to continuous operation of the apparatus or the like, water vapor is forcibly discharged from the interior of the apparatus by the exhaust fan 21, thereby promoting the discharge of water vapor out of the apparatus so that rusting of the metallic components and paper jams caused by moisture can be prevented. Furthermore, the exhaust fan 21 is only operated when the humidity in the interior of the apparatus is excessively high, and therefore noise generated by an operation of the exhaust fan 21 can be suppressed to a minimum.

Next, an embodiment 3 of the present invention will be described.

Figure 10:
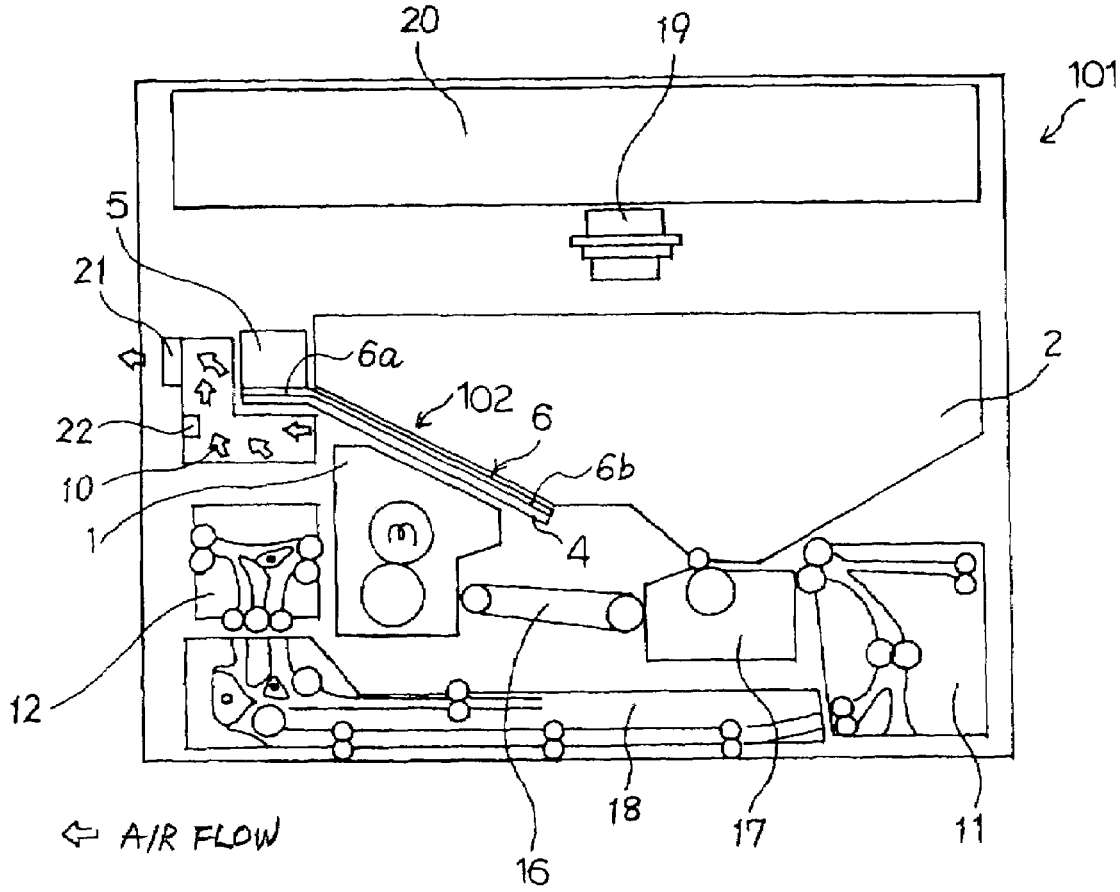
FIG. 10 is a schematic diagram showing the constitution of an image forming apparatus according to an embodiment 3 of the present invention.

FIG. 10 shows the schematic constitution of the image forming apparatus 101 according to embodiment 3. In FIG. 10, members and so on having identical reference numerals to FIG. 8 are similar to the corresponding components of the image forming apparatus 101 described above, and hence detailed description thereof has been omitted.

In this image forming apparatus 101, a water path 24 which serves as a reception portion for preventing water droplets from falling from the thermal insulation apparatus 102 is provided on a lower end portion side of the shielding plate 6 which serves as the thermal insulation apparatus 102. In so doing, water droplets can be prevented from falling from the thermal insulation apparatus 102, and as a result, the components in the apparatus can be prevented from rusting and the paper can be prevented from becoming wet.

Next, an embodiment 4 of the present invention will be described.

Figure 11:
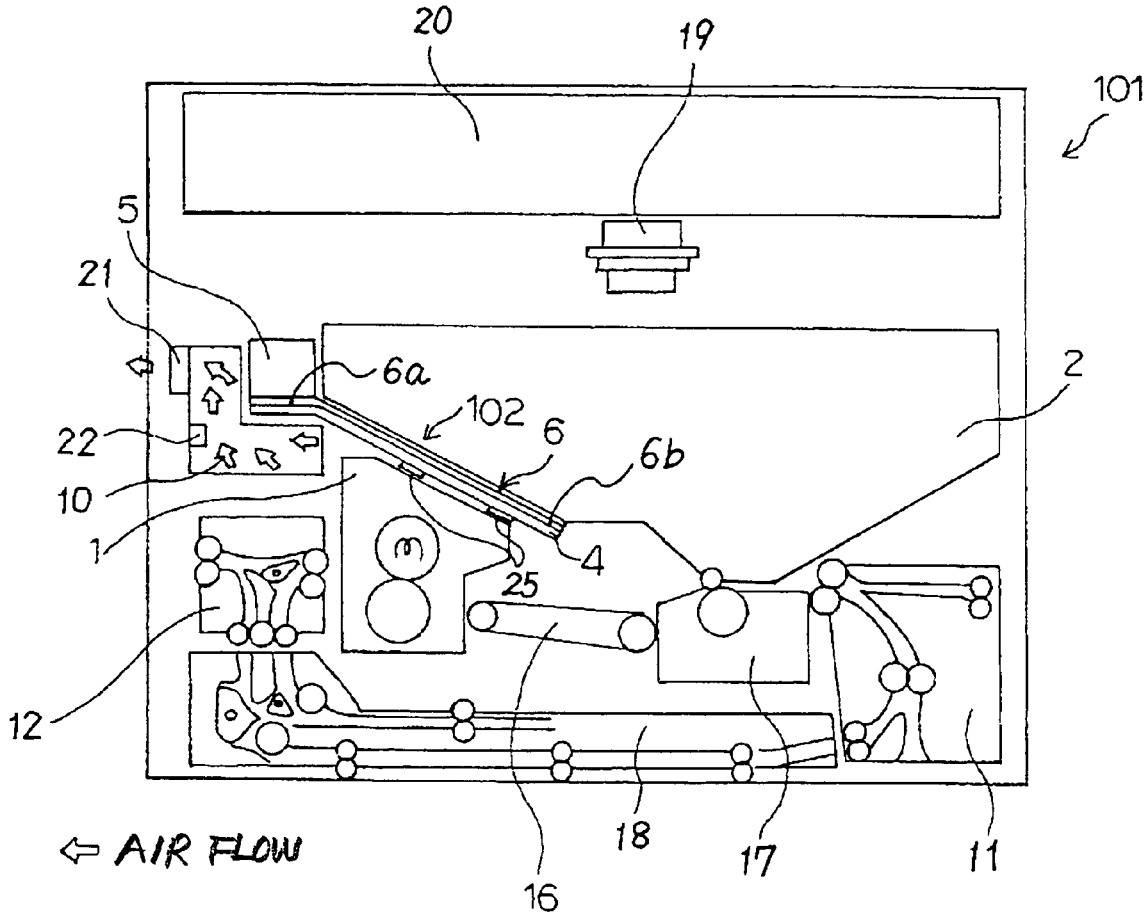
FIG. 11 is a schematic diagram showing the constitution of an image forming apparatus according to an embodiment 4 of the present invention.

FIG. 11 shows the schematic constitution of the image forming apparatus 101 according to embodiment 4. In FIG. 11, members and so on having identical reference numerals to FIG. 8 are similar to the corresponding components of the image forming apparatus 101 described above, and hence detailed description thereof has been omitted.

In this image forming apparatus 101, a sponge 25 serving as a water absorbent member is provided on the shielding plate 6 of the thermal insulation apparatus 102. In so doing, the sponge 25 absorbs and holds the moisture on the shielding plate 6, thereby preventing water droplets from falling from the shielding plate 6. As a result, the components in the apparatus can be prevented from rusting and the paper can be prevented from becoming wet.

Next, an embodiment 5 of the present invention will be described. Similar or equivalent elements to those of the embodiments described above will be described using identical or similar reference numerals.

Figure 12:
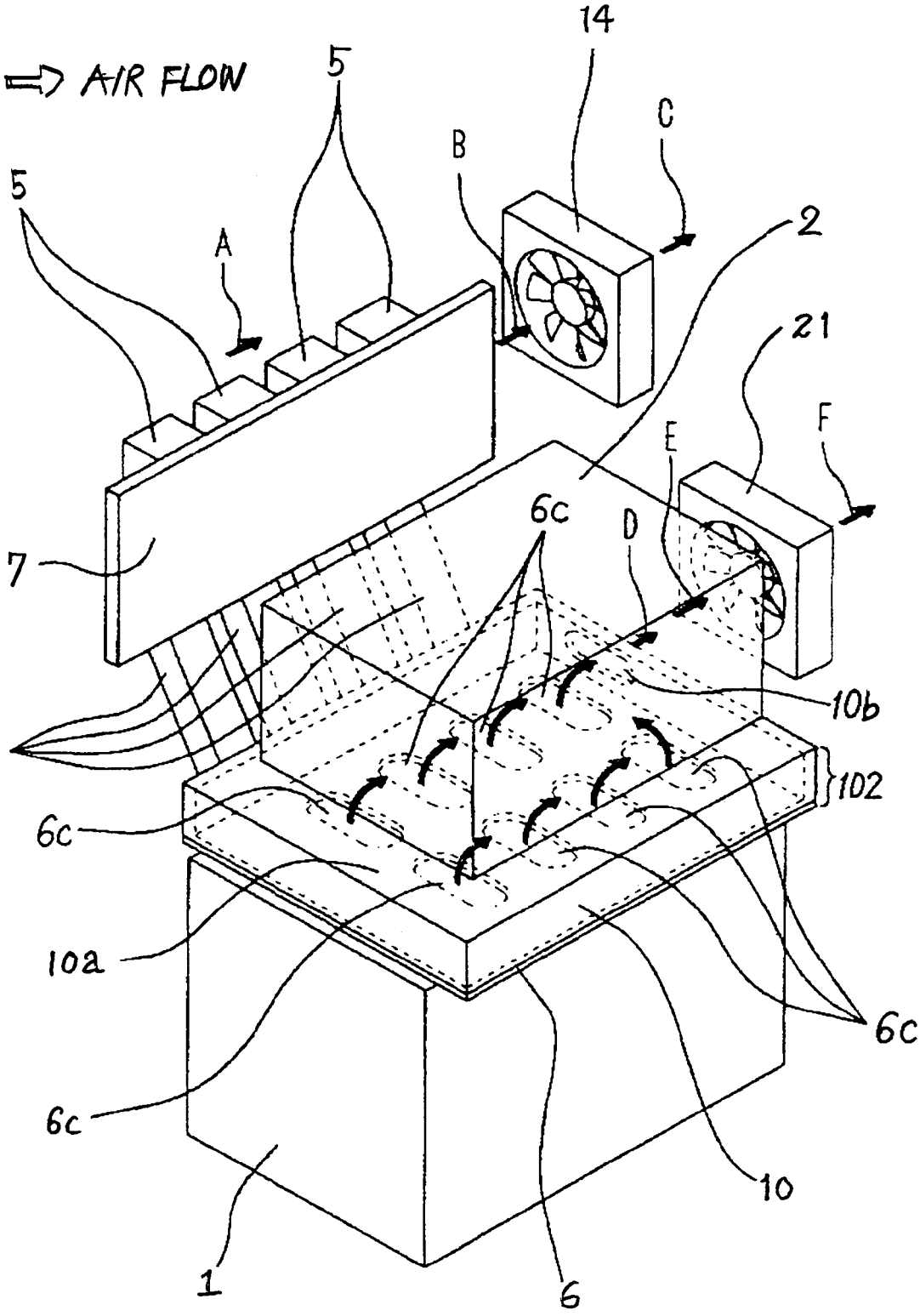
FIG. 12 is a schematic perspective view showing the constitution of the main parts of an image forming apparatus according to an embodiment 5 of the present invention.

FIG. 12 shows the constitution of the main parts of an image forming apparatus according to embodiment 5. This image forming apparatus comprises the cooling subject portion 2, such as the printer engine 2, for forming an electrophotographic image, and the fixing apparatus 1 for heat-fixing the image onto a sheet of paper. Heat transfer from the fixing apparatus 1 to the cooling subject portion 2 is prevented by the heat pipes 4, heat sinks 5, and heat receiving plate 6, and the duct 10 through which water vapor discharged from an intake port 6*c* of the heat receiving plate 6 passes is provided between the cooling subject portion 2 and the heat receiving plate 6.

Despite the increase in the number of constitutional components caused by the increased functionality of copiers, there has been no increase in the size of the copier main body, and hence the space between components is relatively smaller. Therefore, it is more important than in the past to provide measures against heat in the interior of the copier. Embodiment 5 is able to provide a cooling technique that can be implemented in a restricted space. Here, high-performance cooling and a thermal insulation effect can be achieved in a restricted space using cooling means in which the plurality of heat pipes 4 are arranged on the upper portion of the fixing apparatus 1.

To improve the cooling and thermal insulation effects in the interior of the image forming apparatus, embodiment 5 comprises: the fixing apparatus 1 for applying heat and pressure to toner on a sheet of paper in order to fix an image on the paper; the thermal insulation apparatus 102 constituted by the heat receiving plate 6, which is disposed on the upper portion of the fixing apparatus 1 and comprises a plurality of the intake ports 6*c*, and the hollow duct 10 laminated onto the heat receiving plate 6, the thermal insulation apparatus 102 serving to prevent heat transfer from the fixing apparatus 1 by means of the heat pipes 4 inserted into the duct 10 and to discharge water vapor, which is discharged from the fixing apparatus 1 through the intake ports 6*c*, to an exhaust port 10*b* provided in the duct 10; the heat sinks 5, which are provided on an end portion of the heat pipes 4 extending from the thermal insulation apparatus 102 and cooled by the discharge fan 14; and the cooling subject portion 2 disposed on the upper portion of the thermal insulation apparatus 102 for forming an electrophotographic image.

To further improve the cooling and thermal insulation effects in the interior of the image forming apparatus, an airflow is preferably taken in by the discharge fan 14, which is provided on a heat radiating plate 7 for fixing the plurality of heat sinks 5 in a line and serves to discharge the heat of the plurality of heat sinks 5.

Here, copper pipes and pure water sealed inside the copper pipes may be used as the heat pipes 4, and a metal having good thermal conductivity such as aluminum is preferably used for the heat sinks 5.

Further, the hollow duct 10 covers the heat receiving plate 6 with the upper face and side faces thereof, and is capable of transmitting water vapor taken in through the intake ports 6*c* that are drilled into the heat receiving plate 6. The heat receiving plate 6 preferably uses a metal having good thermal conductivity such as aluminum.

Note, however, that the present invention is not limited to a constitution in which a duct surface 10*a* positioned at the lower portion of the duct 10 is left in an open state, and hole portions through which the intake ports 6*c* are exposed may be provided in the duct surface 10*a*. As long as the water vapor generated by the fixing apparatus 1 is led to the exhaust port 10*b*, any means may be employed.

As shown in FIG. 12, in the thermal insulation apparatus 102, the exhaust fan 21 is preferably provided in the vicinity of the exhaust port 10*b* for discharging the water vapor generated by the fixing apparatus 1 after this water vapor passes through the intake ports 6*c*, the duct 10, and the exhaust port 10*b*.

Figure 13:
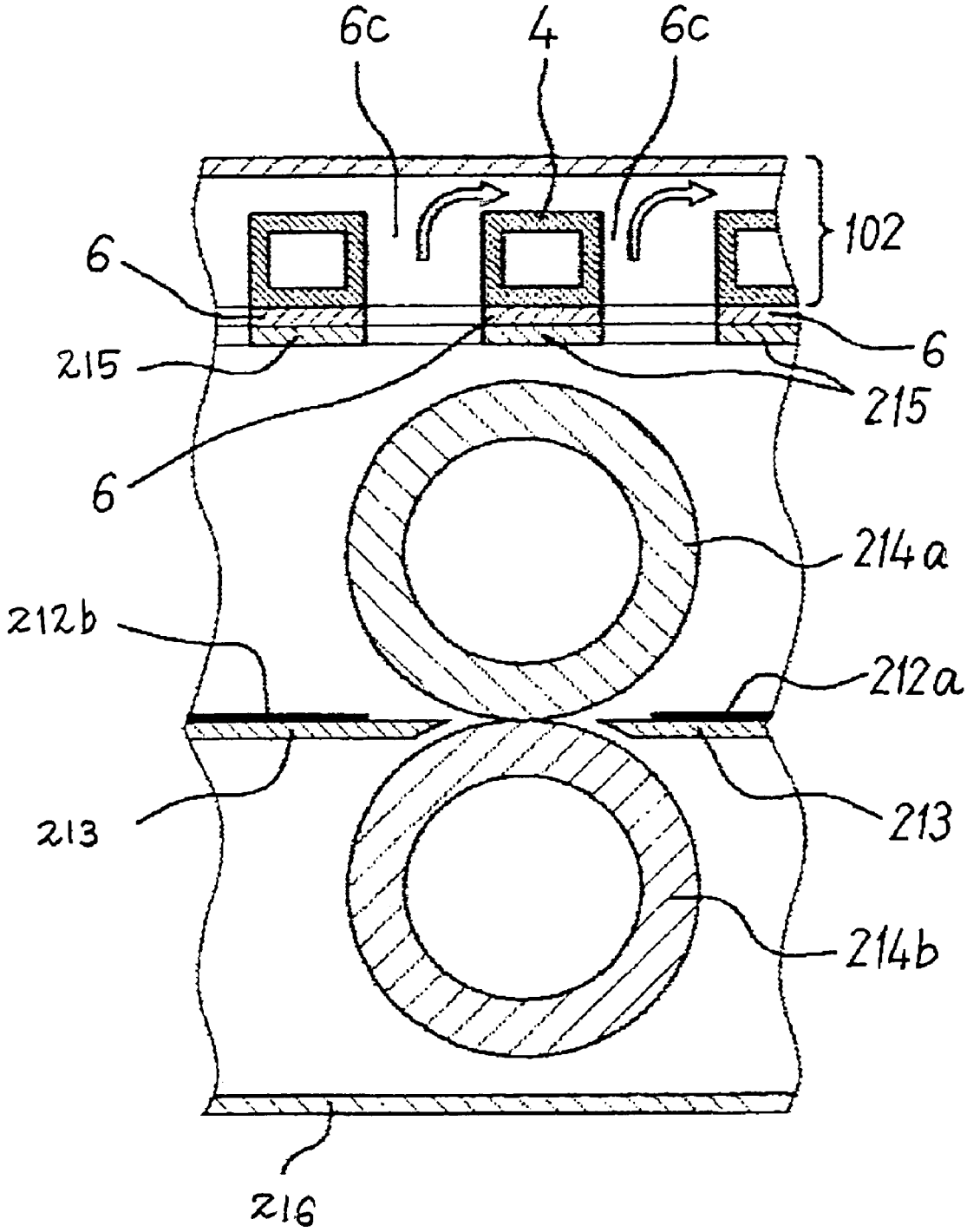
FIG. 13 is a sectional view showing the constitution of the main parts of this image forming apparatus.

FIG. 13 shows the constitution of the main parts of the image forming apparatus according to embodiment 5. As shown in the drawing, the fixing apparatus 1 (see FIG. 12) comprises two drum-shaped heat generating members 214*a* and 214*b* between a top portion 215 and a bottom portion 216. Unfixed paper 212*a* is passed between the heat generating member 214*a* and the heat generating member 214*b* along a right-hand side guide 213.

In the fixing apparatus 1, heat and pressure are applied to the unfixed paper 212*a* by the heat generating members 214*a*, 214*b* to fix the toner image that is adhered to the surface of the paper. The paper is then delivered to a left-hand side guide 213 as fixed paper 212*b*. Water vapor is generated from the unfixed paper 212*a* during this fixing process, and this water vapor is dispersed throughout the fixing apparatus 1. The top portion 215 of the fixing apparatus 1 contacts the heat receiving plate 6 of the thermal insulation apparatus 102, and the water vapor is discharged through the intake ports 6*c*, which serve as connecting opening portions connecting the top portion 215 to the heat receiving plate 6. Furthermore, the heat pipes 4 disposed on either side of the intake ports 6*c* absorb heat from the water vapor and air that are taken into the thermal insulation apparatus 102.

An operation of the image forming apparatus according to embodiment 5 will now be described with reference to FIG. 12.

In the image forming apparatus, the heat of the fixing apparatus 1 is absorbed by the heat receiving plate 6 positioned on the upper portion of the fixing apparatus 1, and this heat is transferred from the heat receiving plate 6 to the heat pipes 4. The heat sinks 5 are caused to transfer a hot airflow A, absorbed from the heat pipes 4 through the heat radiating plate 7, to the discharge fan 14 as an intake airflow B by the negative pressure generated by the discharge fan 14. The discharge fan 14 discharges the intake airflow B to the outside as a heat discharge airflow C. The heat receiving plate 6 transfers the heat of the fixing apparatus 1 to the duct 10 side, while the water vapor of the fixing apparatus 1 is taken into the duct 10 through the intake ports 6*c* drilled into the heat receiving plate 6. The duct 10 discharges exhaust air D which passes through the duct 10 from the exhaust port 10*b*, and the exhaust air D is discharged to the outside of the image forming apparatus as a discharge airflow F by the exhaust fan 21 provided on the outside of the duct 10.

According to embodiment 5, by disposing the heat pipes 4 between the fixing apparatus 1 and the cooling subject portion 2 which must not be affected by heat, the restricted space can be utilized effectively to generate the hot airflow A in the heat sinks 5, and use the hot airflow A to cool the heat that is transferred from the heat pipes 4 provided in the thermal insulation apparatus 102 to the heat sinks 5.

Further, the duct 10 is disposed on the upper portion of the heat receiving plate 6, and hence the water vapor of the fixing apparatus 1 is taken in through the intake ports 6*c* drilled in the heat receiving plate 6. As a result, water droplets can be prevented from adhering to the heat receiving plate 6.

Next, an embodiment 6 of the present invention will be described.

Figure 14:
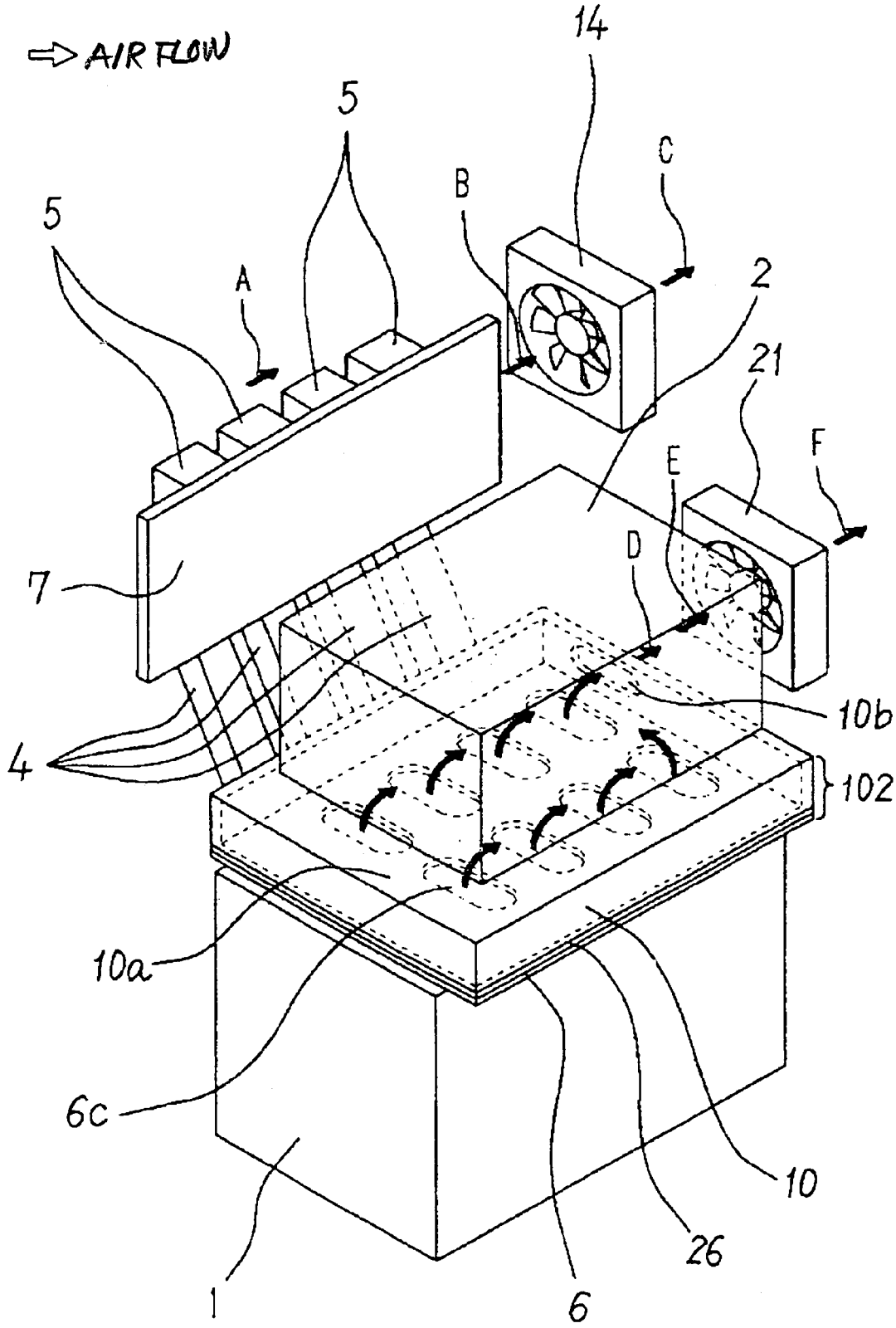
FIG. 14 is a schematic perspective view showing the constitution of the main parts of an image forming apparatus according to an embodiment 6 of the present invention.

FIG. 14 shows the constitution of the main parts of an image forming apparatus according to embodiment 6. Duplicate description of members that are identical to the constitutional elements shown in FIG. 12 has been omitted.

This image forming apparatus comprises: the fixing apparatus 1; the thermal insulation apparatus 102, constituted by the heat receiving plate 6, which is disposed on the upper portion of the fixing apparatus 1 and comprises a plurality of the intake ports 6*c*, a thermal insulation material 26 positioned between the heat receiving plate 6 and the duct 10, and the hollow duct 10 laminated onto the thermal insulation material 26, the thermal insulation apparatus 102 serving to prevent heat transfer from the fixing apparatus 1 by means of the heat pipes 4 inserted into the thermal insulation material 26 and duct 10, and to discharge water vapor, which is discharged from the fixing apparatus 1 through the intake ports 6*c*, to the exhaust port 10*b* provided in the duct 10; the heat sinks 5 which are provided on an end portion of the heat pipes 4 extending from the thermal insulation apparatus 102 and cooled by the discharge fan 14; and the cooling subject portion 2 disposed on the upper portion of the thermal insulation apparatus 102 for forming an electrophotographic image.

Figure 15:
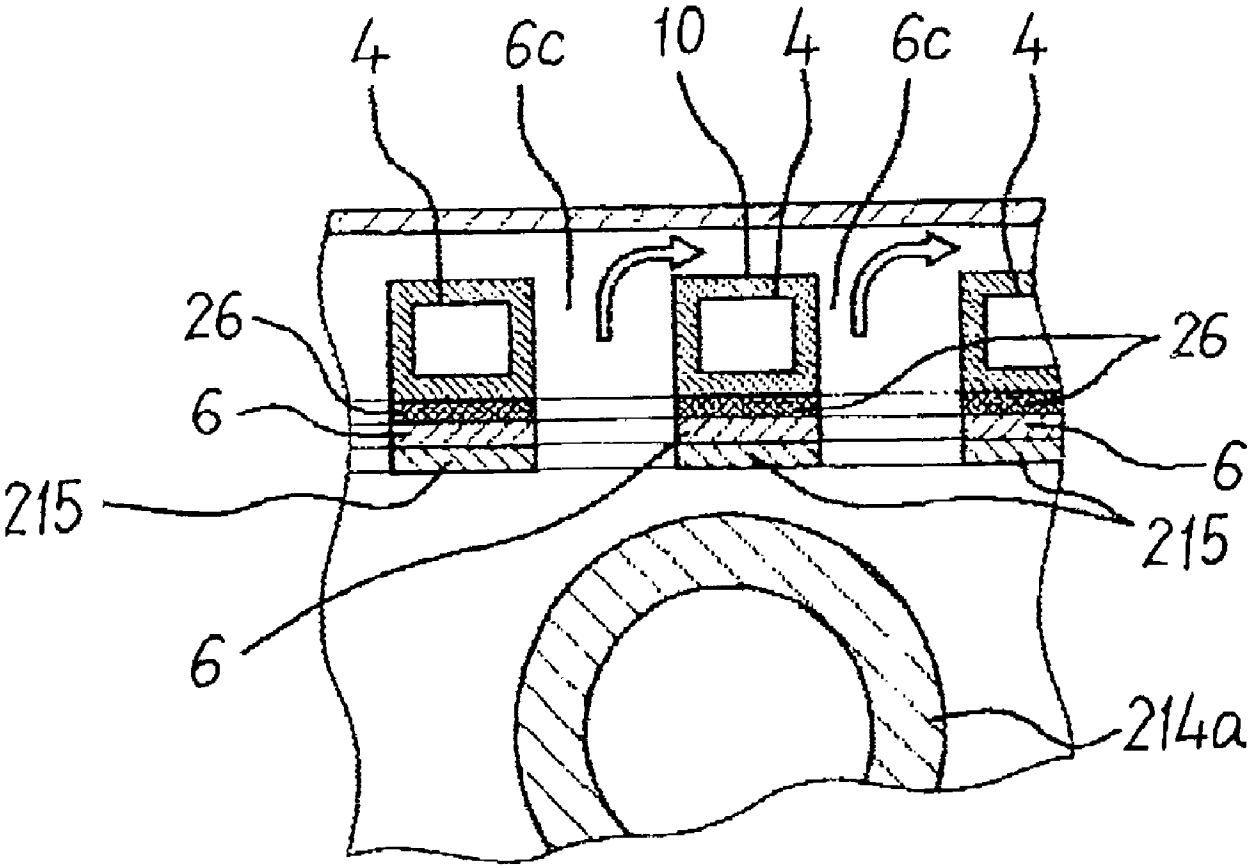
FIG. 15 is a sectional view showing the constitution of the main parts of this image forming apparatus.

FIG. 15 shows the constitution of the main parts of an image forming apparatus according to embodiment 6. Duplicate description of members that are identical to the constitutional elements shown in FIG. 13 has been omitted.

Embodiment 6 differs from embodiment 5 in that the illustrated thermal insulation material 26 is sandwiched between the heat receiving plate 6 and heat pipes 4. The duct 10 is provided on the upper portion of the heat receiving plate 6 via the thermal insulation material 26, and the thermal insulation material 26 protrudes into the interior of the duct 10. As a result, reductions in the thermal efficiency of the heat receiving plate 6 can be prevented, and water vapor from the fixing apparatus 1 can be taken in through the intake ports 6*c* drilled in the heat receiving plate 6, thereby preventing water droplets from adhering to the heat receiving plate 6.

Next, an embodiment 7 of the present invention will be described.

Figure 16:
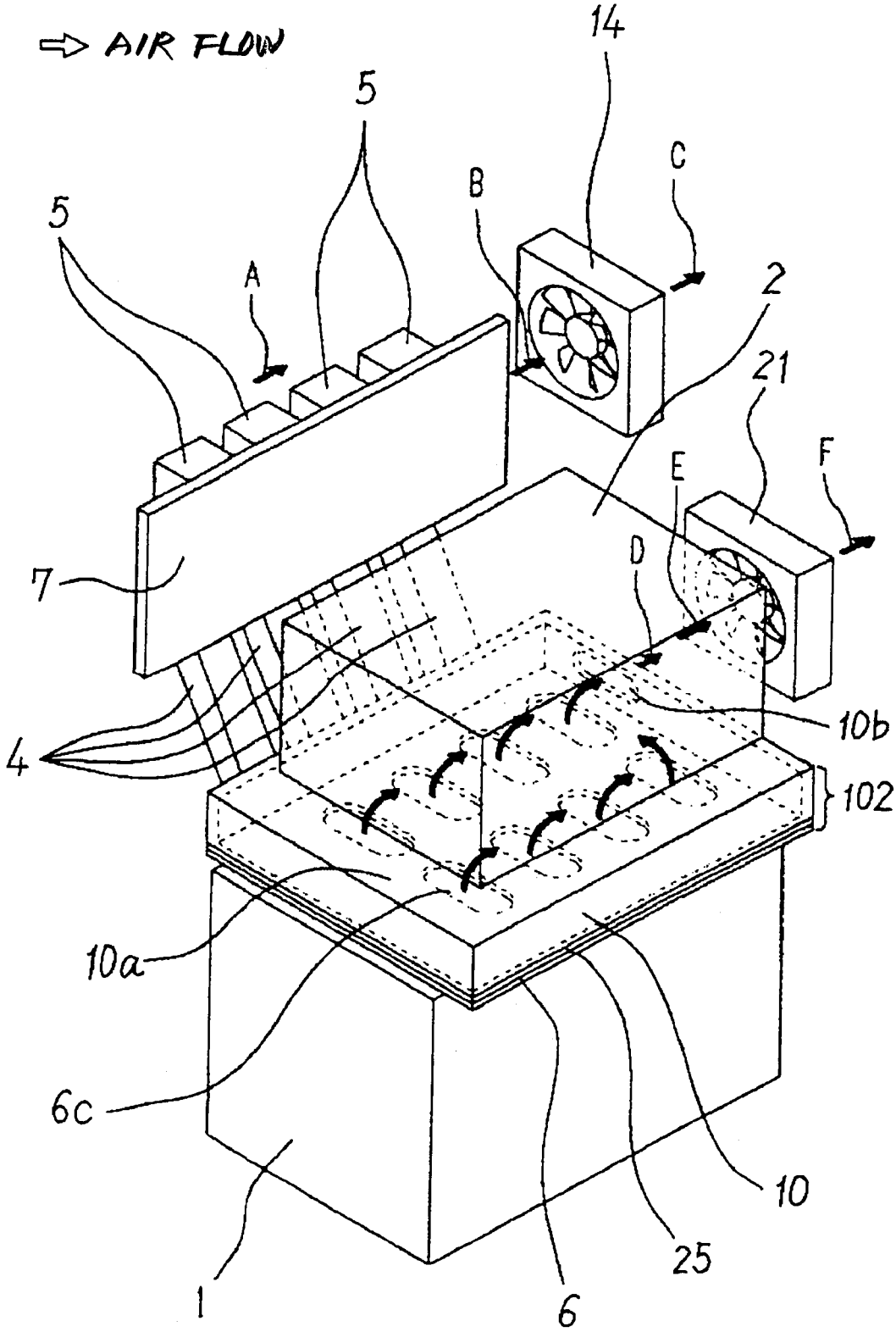
FIG. 16 is a schematic perspective view showing the constitution of the main parts of an image forming apparatus according to an embodiment 7 of the present invention.

FIG. 16 shows the constitution of the main parts of an image forming apparatus according to embodiment 7. Duplicate description of members that are identical to the constitutional elements shown in FIG. 12 has been omitted.

This image forming apparatus comprises: the fixing apparatus 1; the thermal insulation apparatus 102 comprising the heat receiving plate 6, which is disposed on the upper portion of the fixing apparatus 1 and comprises a plurality of the intake ports 6*c*, a water absorbing material 25 positioned between the heat receiving plate 6 and the duct 10, and the hollow duct 10 laminated onto the water absorbing material 25, the thermal insulation apparatus 102 serving to prevent heat transfer from the fixing apparatus 1 by means of the heat pipes 4 inserted into the duct 10, and to discharge water vapor, which is discharged from the fixing apparatus 1 through the intake ports 6*c*, to the exhaust port 10*b* provided in the duct 10; the heat sinks 5 which are provided on an end portion of the heat pipes 4 extending from the thermal insulation apparatus 102 and cooled by the discharge fan 14; and the cooling subject portion 2 disposed on the upper portion of the thermal insulation apparatus 102 for forming an electrophotographic image.

Figure 17:
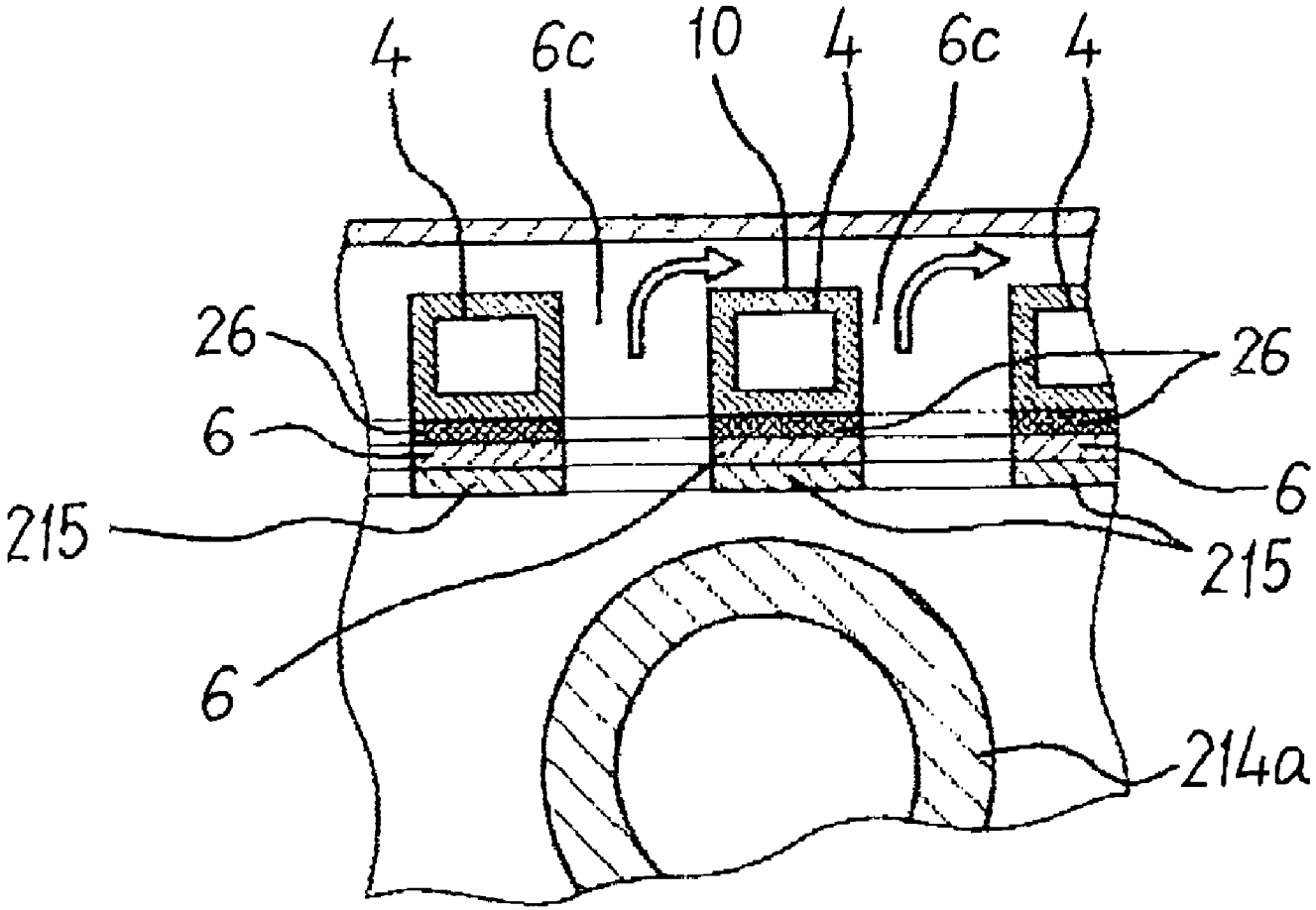
FIG. 17 is a sectional view showing the constitution of the main parts of this image forming apparatus.

FIG. 17 shows the constitution of the main parts of an image forming apparatus according to embodiment 7. Duplicate description of members that are identical to the constitutional elements shown in FIG. 13 has been omitted.

Embodiment 7 differs from embodiment 6 in that the illustrated water absorbing material 25 is sandwiched between the heat receiving plate 6 and heat pipes 4.

In the thermal insulation apparatus 102, the water absorbing material 25 is laminated onto the heat receiving plate 6, which is positioned in the interior of the duct 10. The water absorbing material 25 transmits water vapor into the duct 10, and absorbs water droplets generated when the water vapor condenses. Hence, water can be prevented from accumulating in the interior of the duct 10 in advance.

Since no water accumulates in the interior of the duct 10, reductions in the thermal efficiency of the heat pipes 4 can be prevented, and water vapor from the fixing apparatus 1 can be taken in through the intake ports 6*c* drilled in the heat receiving plate 6, thereby preventing condensed water droplets from adhering to the heat receiving plate 6.

Next, an embodiment 8 of the present invention will be described.

Figure 18:
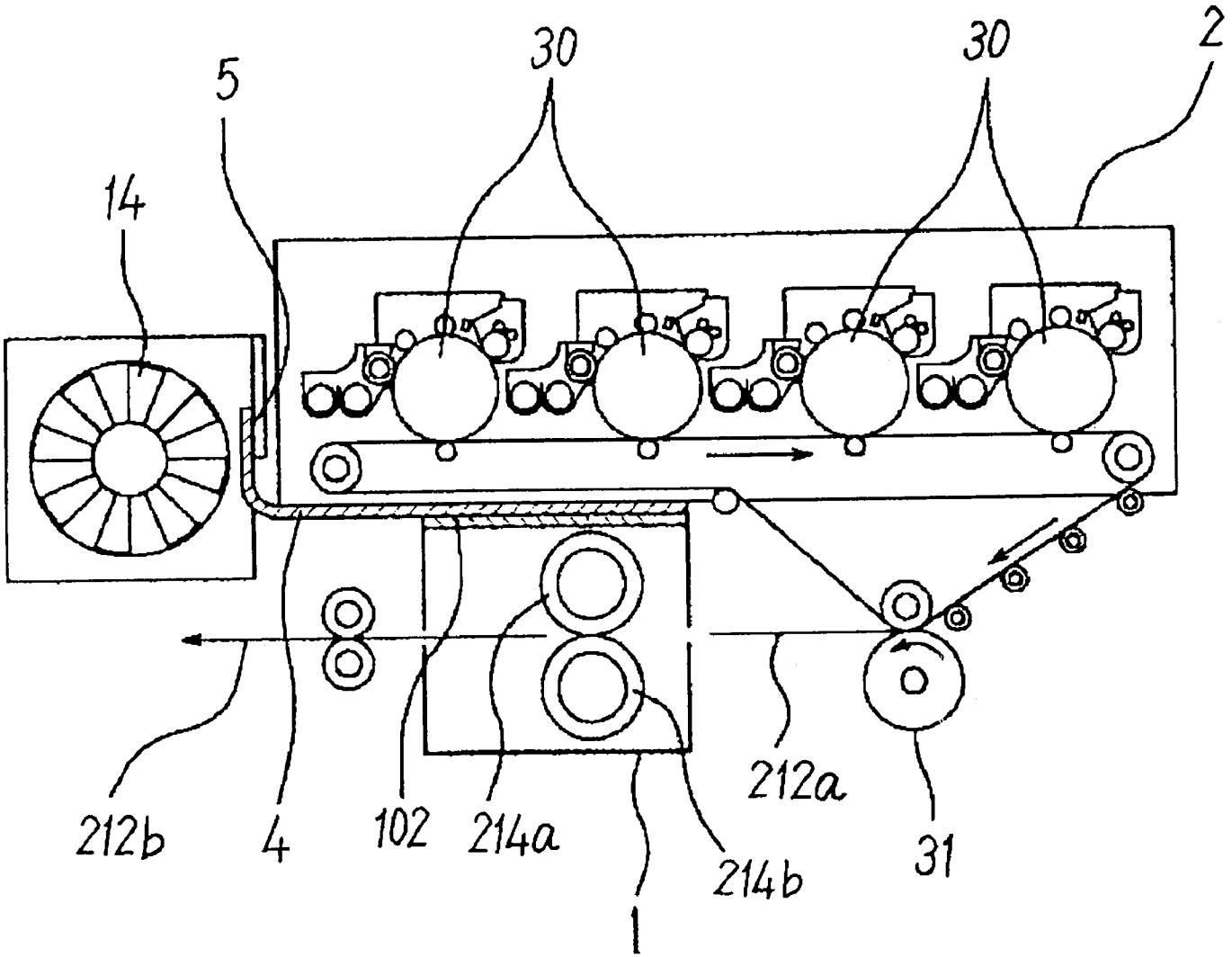
FIG. 18 is a schematic sectional view showing the constitution of an image forming apparatus according to an embodiment 8 of the present invention.

FIG. 18 shows the schematic constitution of an image forming apparatus according to embodiment 8. Duplicate description of members that are identical to the constitutional elements shown in FIG. 12 has been omitted.

This image forming apparatus comprises: the cooling subject portion 2, which comprises a plurality of photosensitive drums 30, charging means disposed around the photosensitive drums 30, exposing means, developing means, primary transfer means, cleaning means, an endless-type intermediate transfer belt, a secondary transfer roller, and a conveyor belt; the fixing apparatus 1, which comprises the heat generating member 214*a* and the heat generating member 214*b* having a heater provided within the drums thereof; and the thermal insulation apparatus 102, which blocks the heat of the fixing apparatus 1 and thereby prevents transfer of the heat to the cooling subject portion 2.

In the image forming apparatus, the unfixed paper 212*a* conveyed from the cooling subject portion 2 via a guide roller 31 passes between the heat generating members 214*a*, 214*b*, where heat and pressure are applied to the toner in order to fix an image onto the now fixed paper 212*b*.

Hence, according to embodiment 8, even when water vapor is generated from the paper as the paper passes through the fixing apparatus 1, the water vapor is discharged from the thermal insulation apparatus 102, and therefore condensation on the heat receiving surface of the heat pipes 4 can be prevented so that the cooling efficiency thereof does not decrease. Moreover, water droplets generated when water vapor condenses in the fixing apparatus 1 can be prevented from falling on paper passing through the fixing apparatus 1, and therefore paper conveyance interruptions can be forestalled.

According to the present invention described above, the entire circumference of the intermediate portion of the heat pipe is insulated from its surroundings by the thermal insulation member, and therefore water vapor that is generated when paper passes through the fixing apparatus and so on can be prevented from adhering to the heat pipe. As a result, the rusting of metallic components caused by water droplets and paper jams caused by falling water droplets can be prevented.

Furthermore, the heat pipe is prevented from receiving heat from any side other than the heat receiving side, and therefore no external thermal resistance is generated, enabling an improvement in the cooling capability.

Further, the cooling subject portion is insulated by the thermal insulation apparatus and thereby protected from heat, while heat and water vapor can be discharged forcibly by the duct and fan. Thus, rusting of the metallic components, paper jams, and so on caused by moisture can be prevented sufficiently. Moreover, the fan is only operated when the humidity in the interior of the apparatus is high, and therefore the noise generated by the fan can be suppressed to a minimum.

Various modifications will become possible for those skilled in the art after receiving the teachings of the present disclosure, without departing from the scope thereof.

What is claimed is:

1. An electrophotographic image forming apparatus for forming an image on a sheet of paper, comprising:

a shielding member configured to shield a fixing apparatus for fixing an image on said sheet of paper and a cooling subject portion in the interior of said image forming apparatus from each other;

a heat pipe provided on said shielding member, one end side of which is disposed between said fixing apparatus and said cooling subject portion to serve as a heat receiving portion, and another end side of which is disposed in a higher position than said one end side to serve as a heat radiating portion; and a thermal insulation member which covers the entire circumference of an intermediate portion of said heat pipe between said two end sides of said heat pipe.

2. The image forming apparatus as claimed in claim 1, further comprising:

a duct configured to connect an upper side of said fixing apparatus to the exterior of said image forming apparatus.

3. The image forming apparatus as claimed in claim 2, wherein an inlet of said duct is disposed near an upper portion of a paper outlet of said fixing apparatus.

4. The image forming apparatus as claimed in claim 2, wherein at least a part of an inner wall of said duct is constituted by said thermal insulation member.

5. The image forming apparatus as claimed in claim 2, further comprising:

a fan configured to forcibly discharge air inside said duct to the outside of said image forming apparatus;

a humidity sensor provided in said image forming apparatus; and a controller configured to drive said fan when a humidity value detected by said humidity sensor is greater than a preset reference value, and stopping said fan when said humidity value is smaller than said reference value.

6. An electrophotographic image forming apparatus for forming an image on a sheet of paper, comprising:

a thermal insulation apparatus provided between a fixing apparatus for fixing an image on said sheet of paper and a cooling subject portion in the interior of said image forming apparatus;

a duct configured to connect an upper side of said fixing apparatus to the exterior of said image forming apparatus, wherein said duct is disposed on a side of said thermal insulation apparatus facing said fixing apparatus;

a fan configured to forcibly discharge air inside said duct to the outside of said image forming apparatus;

a humidity sensor provided in said image forming apparatus; and a controller configured to drive said fan when a humidity value detected by said humidity sensor is greater than a preset reference value, and stop said fan when said humidity value is smaller than said reference value.

7. The image forming apparatus as claimed in claim 6, further comprising a reception portion provided on a lower end portion side of said thermal insulation apparatus for receiving water droplets from said thermal insulation apparatus.

8. The image forming apparatus as claimed in claim 6, further comprising a water absorbent member provided on said thermal insulation apparatus.

9. The image forming apparatus as claimed in claim 8, wherein said water absorbent member is a sponge.

10. The image forming apparatus as claimed in claim 6, wherein said thermal insulation apparatus is constituted to prevent heat transfer from said fixing apparatus to said cooling subject portion by means of a heat pipe, a heat sink, and a heat receiving plate.

11. An electrophotographic image forming apparatus for forming an image on a sheet of paper, comprising:

a thermal insulation apparatus provided between a fixing apparatus for fixing an image on said sheet of paper and a cooling subject portion in the interior of said image forming apparatus;

a duct for connecting an upper side of said fixing apparatus to the exterior of said image forming apparatus;

a fan for forcibly discharging air inside said duct to the outside of said image forming apparatus;

a humidity sensor provided in said image forming apparatus; and a controller configured to drive said fan when a humidity value detected by said humidity sensor is greater than a preset reference value, and stopping said fan when said humidity value is smaller than said reference value, wherein said thermal insulation apparatus is disposed on an upper portion of said fixing apparatus, and is constituted to prevent heat transfer from said fixing apparatus by means of a heat receiving plate having a plurality of intake ports, a hollow duct laminated onto said heat receiving plate, and a heat pipe inserted into said duct, and to discharge water vapor, which is discharged from said fixing apparatus through said intake ports, to an exhaust port provided in said duct, said image forming apparatus further comprising a heat sink which is provided on an end portion of said heat pipe extending from said thermal insulation apparatus and cooled by a cooling fan.

12. The image forming apparatus as claimed in claim 11, further comprising a thermal insulation material provided between said heat receiving plate and said duct.

13. The image forming apparatus as claimed in claim 11, further comprising a water absorbing material provided between said heat receiving plate and said duct.

* * * * *